US009304465B2

(12) United States Patent
Lopez et al.

(10) Patent No.: US 9,304,465 B2
(45) Date of Patent: Apr. 5, 2016

(54) DETERMINING THE CONDUCTIVITY OF A LIQUID

(71) Applicant: HEWLETT-PACKARD DEVELOPMENT COMPANY, L.P., Houston, TX (US)

(72) Inventors: Matthew G. Lopez, Escondido, CA (US); David F. Chiu, San Diego, CA (US); David Sabo, San Diego, CA (US); John W. Godden, San Diego, CA (US); Christopher S. Tanner, San Diego, CA (US); Eric G. Nelson, Eagle, ID (US); Guang Jin Li, San Diego, CA (US); James Michael Pingel, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 235 days.

(21) Appl. No.: 13/901,782

(22) Filed: May 24, 2013

(65) Prior Publication Data

US 2014/0348526 A1 Nov. 27, 2014

(51) Int. Cl.
*G03G 15/10* (2006.01)
*G03G 15/00* (2006.01)

(52) U.S. Cl.
CPC ..... *G03G 15/55* (2013.01); *G03G 15/10* (2013.01); *G03G 15/105* (2013.01)

(58) Field of Classification Search
CPC ..... G03G 15/104–15/105; G03G 9/12; G03G 9/135; G03G 2215/0658; G03G 15/10; G03G 15/55
See application file for complete search history.

(56) References Cited

U.S. PATENT DOCUMENTS

| | | | | |
|---|---|---|---|---|
| 3,932,034 | A * | 1/1976 | Takahashi | 399/61 |
| 4,076,857 | A * | 2/1978 | Kasper et al. | 430/103 |
| 5,966,561 | A | 10/1999 | Yamaguchi | |
| 7,406,274 | B2 | 7/2008 | Shin et al. | |
| 2010/0296825 | A1 | 11/2010 | Kella et al. | |
| 2011/0102003 | A1 | 5/2011 | Bhattacharyya | |
| 2011/0217082 | A1 | 9/2011 | Frydman et al. | |

FOREIGN PATENT DOCUMENTS

WO WO-2012105938 8/2012

OTHER PUBLICATIONS

ViSmart™ SenGenuity Sensor Engine Technology; Viscosity Sensor for Process Control in Printing Ink Applications; http://www.sengenuity.com/tech_ref/Process%20Control%20for%20Printing%20Ink%20Applications.pdf >; 2009 Vectron International.

* cited by examiner

*Primary Examiner* — David Gray
*Assistant Examiner* — Andrew V Do

(57) ABSTRACT

In one example, a processor readable medium has instructions thereon that, when executed by a processor, cause a system to detect a change in electrical conduction of a liquid moving at an interface between two surfaces and determine a conductivity of the liquid based on the detected change in conduction.

13 Claims, 8 Drawing Sheets

DETERMINING THE CONDUCTIVITY OF A LIQUID

BACKGROUND

Liquid electro-photographic (LEP) printing uses a special kind of ink to form images on paper and other print substrates. LEP ink includes charged polymer particles dispersed in a carrier liquid. The polymer particles are sometimes referred to as toner particles and, accordingly, LEP ink is sometimes called liquid toner. LEP ink usually also includes a charge control agent, called a "charge director", that helps control the magnitude and polarity of the charge on the particles. The LEP printing process involves placing an electrostatic pattern of the desired printed image on a photoconductor and developing the image by applying a thin layer of LEP ink to the charged photoconductor. Charged toner particles in the ink adhere to the pattern of the desired image on the photoconductor. The ink image is transferred from the photoconductor to a heated intermediate transfer member, evaporating much of the carrier liquid to dry the ink film. The ink film is then pressed on to the cooler substrate and frozen in place at a nip between the intermediate transfer member and the substrate.

DRAWINGS

The same part numbers designate the same or similar parts throughout the figures.

DESCRIPTION

A new technique has been developed to determine the conductivity of a liquid at the interface between two surfaces. Examples of the new technique were developed to help improve the determination of the conductivity of LEP ink under the comparatively high electric fields applied to the ink in HP Indigo® printers—the so-called "high field" conductivity of the ink. High field conductivity is an important factor in assessing and maintaining the desired level of charge in the ink. It has been discovered that there is a Paschen breakdown like change in conduction in LEP ink at the interface between rotating rollers in the printers and that the region within which the "Paschen breakdown" occurs varies according to the conductivity of the ink. Thus, it is possible to determine the conductivity of the ink by observing the region of Paschen breakdown.

One example method for determining the conductivity of an LEP ink or other liquid at the interface between two rotating rollers includes (1) applying multiple voltages between the two rotating rollers, (2) measuring current through the liquid at the interface between the rollers for each voltage to identify a Paschen breakdown, and then (3) determining a conductivity of the liquid based on the identified Paschen breakdown. Examples may be implemented in HP Indigo® printers using existing printer components programmed or otherwise configured to monitor the high field conductivity of the ink so that appropriate adjustments may be made to the charge director to maintain the desired conductivity. Examples of the new technique, however, are not limited to LEP printing, LEP ink or rotating rollers, but may be implemented in other devices with other liquids. Accordingly, these and other examples shown in the figures and described below illustrate but do not limit the invention which is defined in the Claims following this Description.

As used in this document, "LEP ink" means a liquid that includes charged polymer particles suitable for electro-photographic printing; "liquid" means a fluid not composed primarily of a gas or gases; and "Paschen breakdown" means the point at which, or the region through which, the relationship between current and voltage changes from one function to another function.

Figure 2:
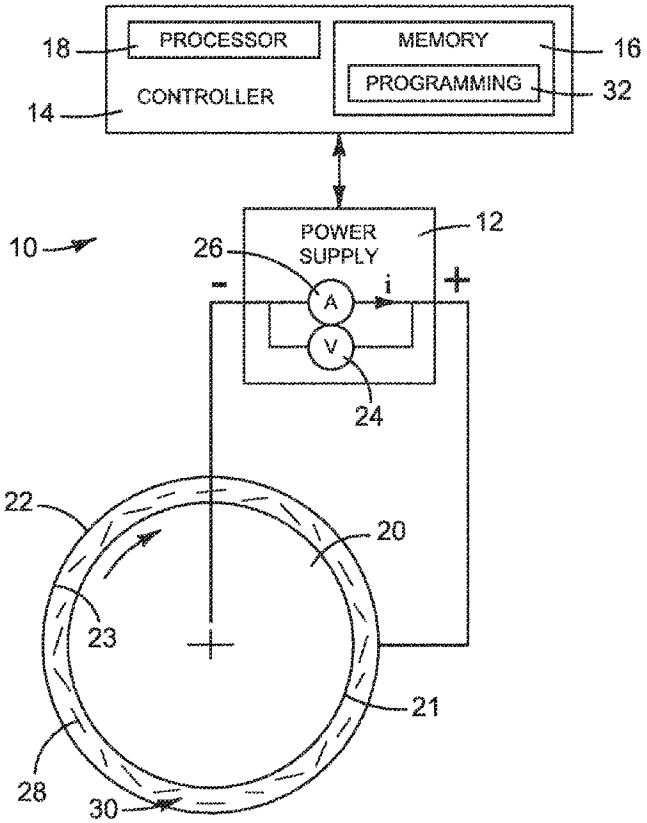
FIGS. 1 and 2 illustrate examples of a system for determining the conductivity of a liquid at the interface between two surfaces.
Figure 1:
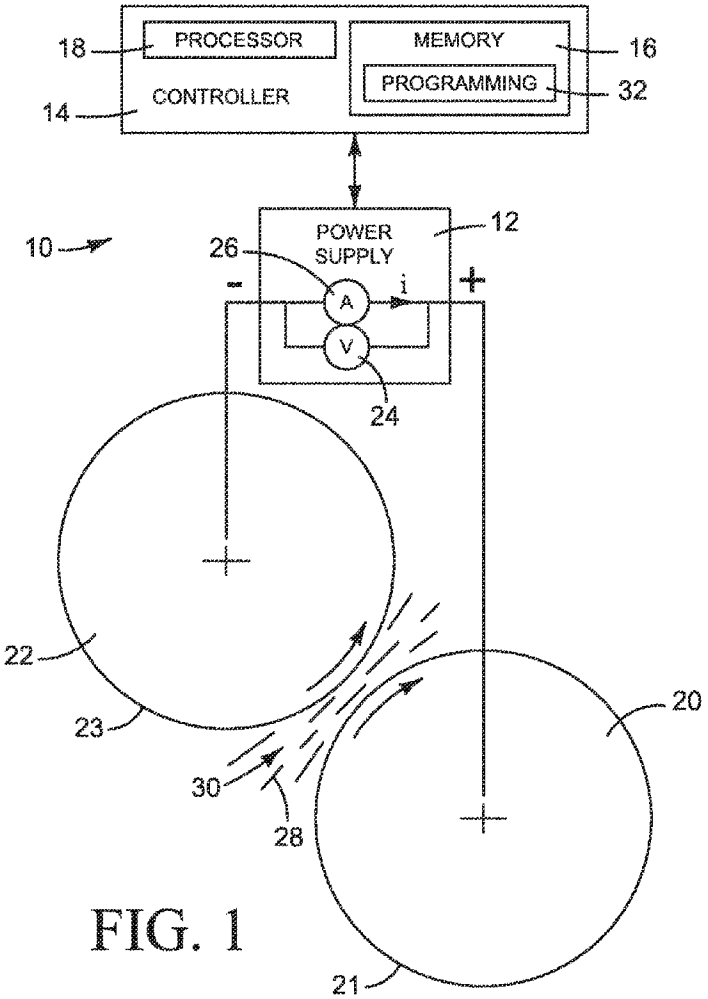
Figure 3:
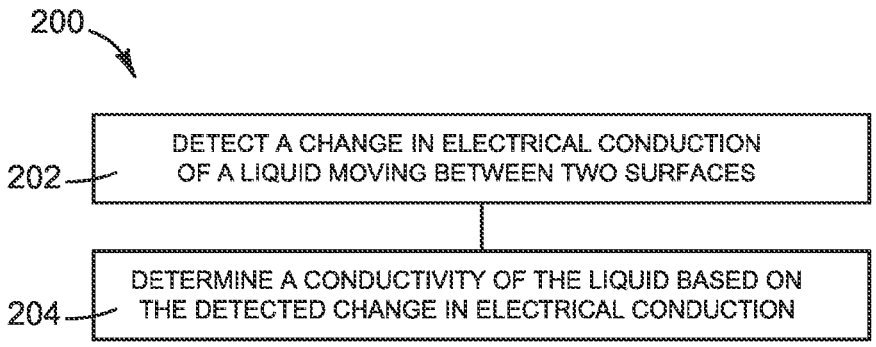
FIG. 3 is a flow diagram illustrating one example of a method for determining the conductivity of a liquid at the interface between two surfaces, such as might be implemented in the system of FIG. 1 or FIG. 2.

FIGS. 1 and 2 illustrate examples of a system 10 for determining the conductivity of a liquid at the interface between two surfaces. FIG. 3 is a flow diagram illustrating one example of a method 200 for determining the conductivity of a liquid at the interface between two surfaces, such as might be implemented in a system 10 shown in FIG. 1 or FIG. 2. Each example of system 10 in FIGS. 1 and 2 includes a power supply 12 and a programmable controller 14 operatively connected to power supply 12. Controller 14 includes a memory or other suitable processor readable medium 16 and a processor 18. In the example of FIG. 1, power supply 12 is connected to first and second rollers 20, 22 and includes a voltage meter 24 to measure voltage applied between rotating rollers 20, 22 and a current meter 26 to measure current through a liquid 28 moving at the interface 30 between the outer surfaces 21, 23 of rollers 20, 22. In the example of FIG. 2, power supply 12 is connected to a shaft 20 rotating inside a stationary bearing or other sleeve 22 and includes a voltage meter 24 to measure voltage applied between shaft 20 and sleeve 22 and a current meter 26 to measure current through a liquid 28 moving at the interface 30 between the outer surface 21 of shaft 20 and the inner surface 23 of sleeve 22.

Referring now also to FIG. 3, programming 32 in controller memory 16 includes instructions that when executed by processor 18 cause system 10 to detect a change in electrical conduction of liquid 28 at interface 30 (block 202 in FIG. 3) and determine the conductivity of liquid 28 based on the detected change in conduction (block 204 in FIG. 2). In one specific example, shown in FIG. 4, multiple voltages are applied between surfaces 21, 23 (block 206) and, for each voltage, the current through liquid 28 is measured (block 208) and the change in conduction is detected as the point at which the measured current as a function of the applied voltage changes from a first function to a second function (block 210). Then, the conductivity of liquid 28 is determined as a function of the measured current at the point of change (block 212).

Figure 4:
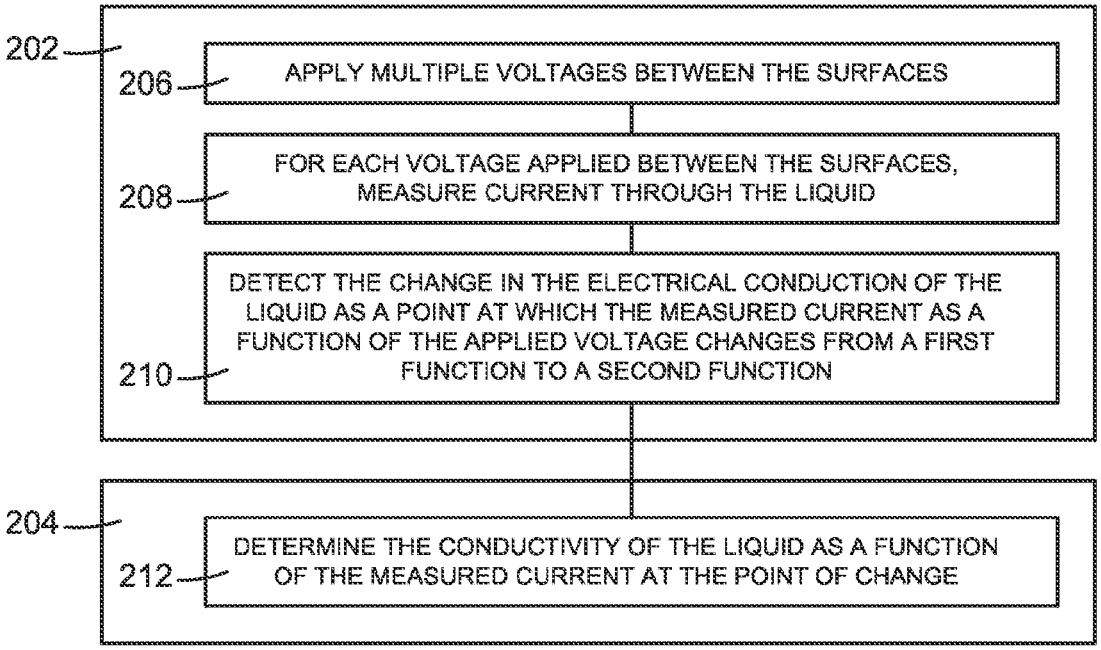
FIG. 4 is a flow diagram illustrating one specific implementation of the method of FIG. 3.
Figure 5:
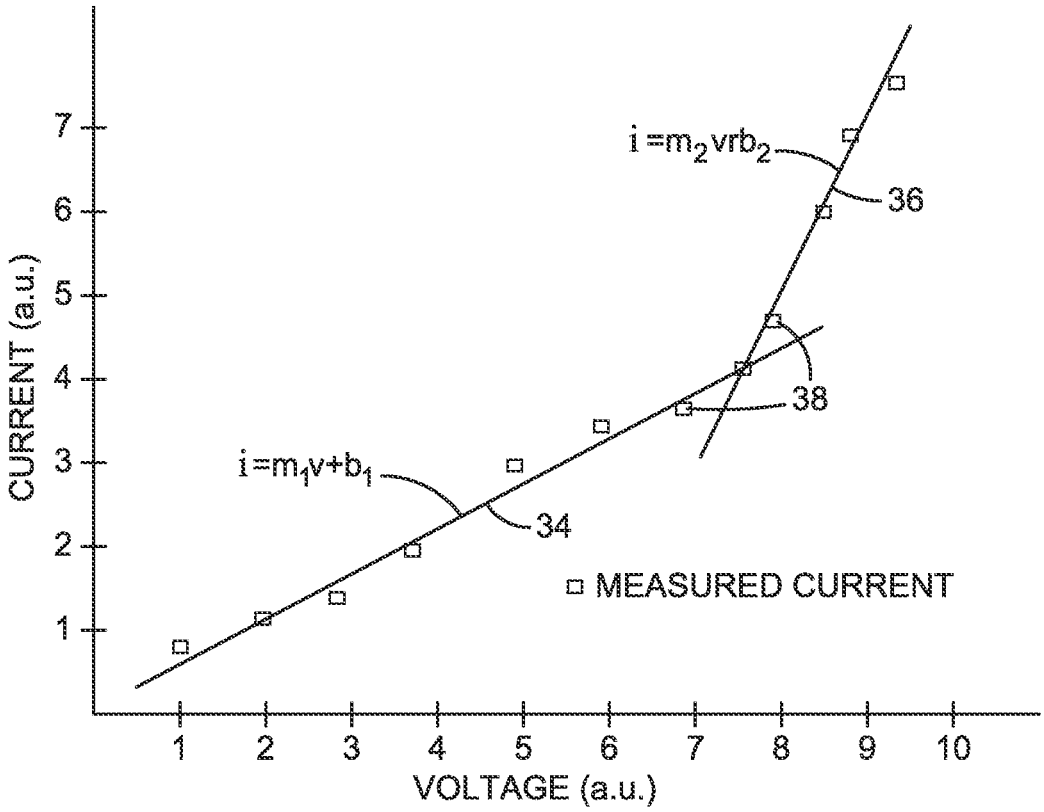
FIGS. 5 and 6 are graphs illustrating one example of a set of functions for determining the conductivity of a liquid using the method of FIG. 4.
Figure 6:
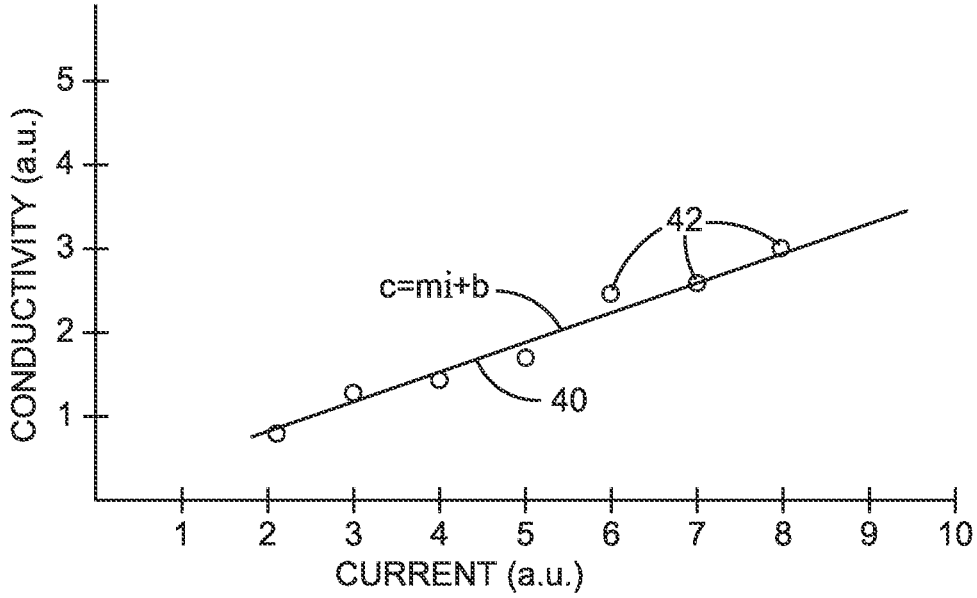

The graphs of FIGS. 5 and 6 illustrate one example of a set of functions for determining the conductivity of liquid 28 using the method of FIG. 4. FIG. 5 depicts an idealized graphical representation of one example of a functional relationship between the measured current and the applied voltage for a liquid 28, showing the point at which this relationship changes from a first function to a second function. FIG. 6 is an idealized graphical representation of one example of a functional relationship between the measured current at the point of change in FIG. 5 and the conductivity of the liquid 28.

Referring to FIG. 5, the relationship between the measured current i (in arbitrary units, a.u.) and the applied voltage v (also in arbitrary units, a.u.) for a single liquid 28 changes from a first function 34 at lower applied voltages, a line $i=m_1v+b_1$ in this example, to a second function 36 at higher applied voltages, a line $i=m_2v+b_2$ in this example, where m is the slope and b is the y intercept for each line 34, 36. Each line 34 and 36 represents multiple measured data points 38 and may be established using any suitable "best fit" technique. The current i at which the relationship changes from line 34 to line 36 for the liquid 28 in this example is about 7.5 a.u.

Referring to FIG. 6, the functional relationship 40 between the measured current i at the point of change and the conductivity of a liquid 28 may be established, for example, empirically by detecting the point of change for liquids for which the conductivity is known and fitting a line (or curve) to multiple data points 42. Thus, each data point 42 along line 40 in FIG. 6 represents the point of change in a graph like that shown in FIG. 5 for measured current as a function of applied voltage for a liquid for which the conductivity is known. Once function 40 is established, the conductivity c of a particular liquid 28 may be determined as a function of the measured current at the point of change in FIG. 5, for example by computing the conductivity according to the equation for line 40 in FIG. 6, c=mi+b, by plotting to line 40 on the graph in FIG. 6, or by locating the conductivity in a table representing line 40.

Controller 14 in FIGS. 1 and 2 represents generally the programming, processor(s) and associated memory(ies), and the electronic circuitry and components needed to control the operative elements of system 10 and perform the computational or other analytical functions for determining conductivity. The components of controller 14 need not all reside together on a single device or in a single processor readable medium. For example, power supply 12 may itself include a microcontroller that performs some of the control functions for system 10, such as controlling a voltage source, a current source, and/or meters 24 and 26 and recording data for analysis by a processor that is physically remote from the power supply. Also, while voltage meter 24 and current meter 26 are shown integral to power supply 12, one or both meters 24, 26 or other suitable sensors could be separate from power supply 12.

With continued reference to FIGS. 1 and 2, in the examples shown, one or both surfaces 21 and 23 move against or close to the other surface with a thin layer of liquid 28 at the interface 30 between surfaces 21, 23. As noted above with reference to implementation in an LEP printer, it has been discovered that a thin layer of LEP ink undergoes a Paschen breakdown like change in conduction at the interface between rotating rollers and the point at which this Paschen breakdown occurs varies according to the conductivity of the ink. Thus, it is possible to determine the conductivity of LEP ink by observing the point of Paschen breakdown using the method of FIG. 3. The layer of ink between rollers in an LEP printer is usually about 3 μm to 5 μm thick at the interface between the rollers. While the method described above for determining the conductivity of LEP ink or another liquid 28 may be useful for thicker layers, it is expected that the transition in the liquid from one type of electrical conduction to another (ionization at the Paschen breakdown for example) determined using this method will be most effective when a liquid layer 28 is 2 mm or thinner. Accordingly, "close" as used in this context means 2 mm or less.

Figure 7:
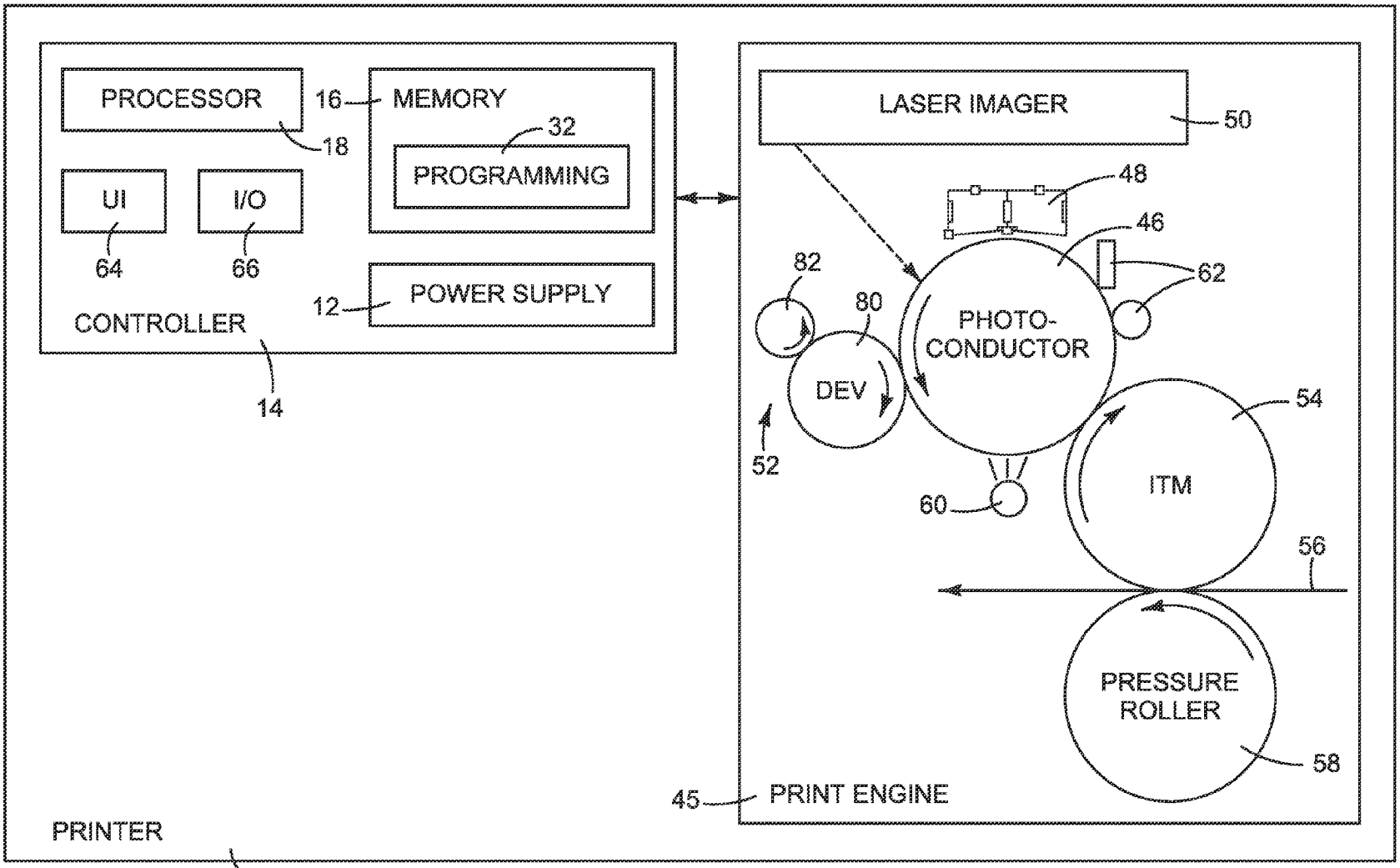
FIGS. 7 and 8 are diagrammatic and perspective views, respectively, illustrating an LEP printer implementing one example of a system for determining the conductivity of an LEP ink.
Figure 8:
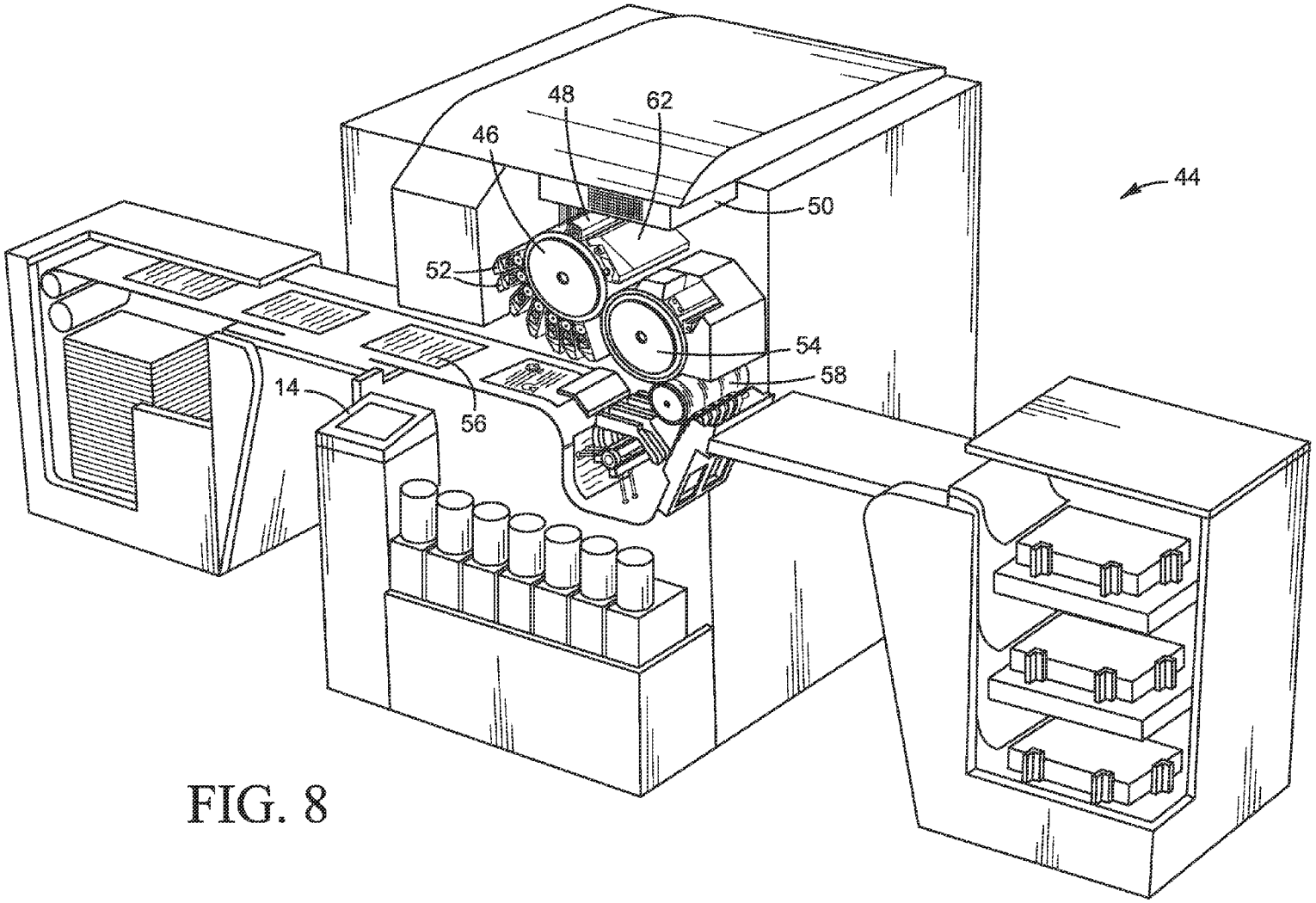
Figure 9:
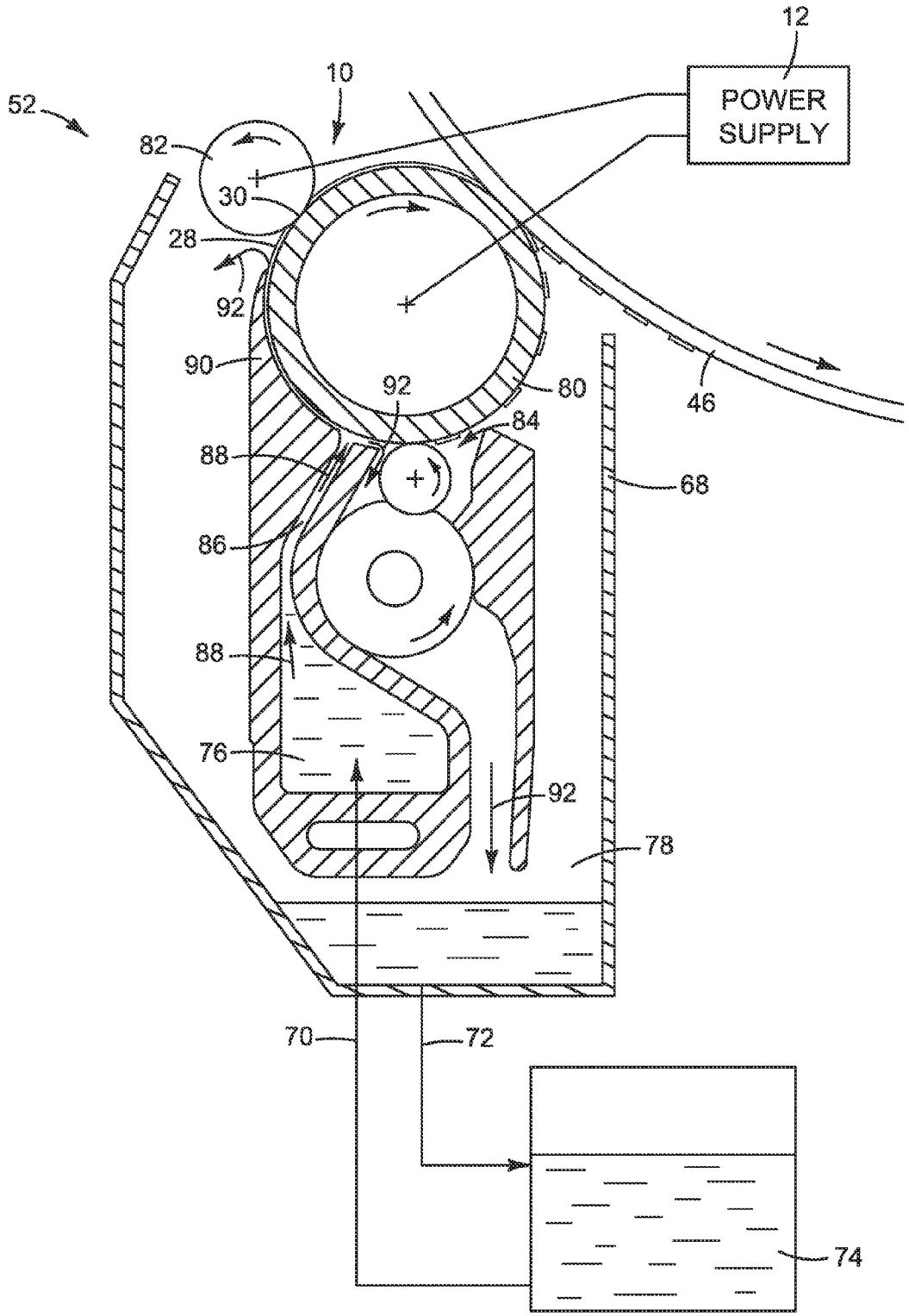
FIG. 9 is a close up view of one of the developer units in the printer shown in FIG. 8.
Figure 10:
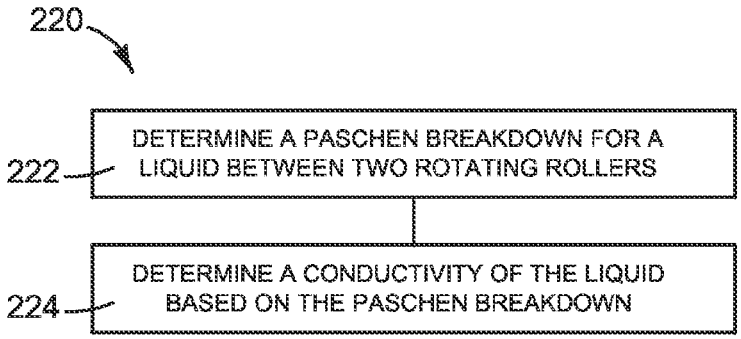
FIG. 10 is a flow diagram illustrating one example of a method for determining the conductivity of a liquid at the interface between two rollers, such as might be implemented in the LEP printer shown in FIGS. 7 and 8.

FIGS. 7 and 8 illustrate an LEP printer 44 implementing one example of a system 10 (FIG. 9) for determining the conductivity of an LEP ink used in printer 44. FIG. 9 is a close up view of one of the developer units in printer 44. FIG. 10 is a flow diagram illustrating one example of a method 220 for determining the conductivity of a liquid at the interface between two rotating rollers, such as might be implemented in the LEP printer 44 shown in FIGS. 7 and 8. Referring first to FIGS. 7 and 8, printer 44 includes a print engine 45 and a controller 14 operatively coupled to print engine 45. Controller 14 in FIGS. 7 and 8 represents generally the programming, processor and associated memory, and the electronic circuitry and components needed to control the operative elements of printer 44, including the operative elements of print engine 45 described below. Although controller 14 and print engine 45 are shown in different blocks in the block diagram of FIG. 7, some of the control elements of controller 14 may reside in print engine 45. For example, one or more power supplies 12 in controller 14 may be physically located in the printer close to the print engine components they power.

In a typical LEP printer 44, a uniform electrostatic charge is applied to a photoconductive surface, the outer surface of a photoconductor drum 46 for example, by a scorotron or other suitable charging device 48. A scanning laser or other suitable photo imaging device 50 exposes selected areas on photoconductor 46 to light in the pattern of the desired printed image. A thin layer of LEP ink is applied to the patterned photoconductor 46 using a developer 52. As best seen in FIG. 8, developer 52 is a typically complex mechanism that includes multiple units 52 each supplying different color inks to photoconductor 46. The latent image on photoconductor 46 is developed through the application of ink which adheres to the charged pattern on photoconductor 46, developing the latent electrostatic image into an ink image. The ink is transferred from photoconductor 46 to an intermediate transfer member (IITM) 54 and then from intermediate transfer member 54 to sheets or a web of print substrate 56 passing between intermediate transfer member 54 and a pressure roller 58. A lamp or other suitable discharging device 60 removes residual charge from photoconductor 46 and ink residue is removed at a cleaning station 62 in preparation for developing the next image or for applying the next color plane.

An LEP printer controller 12 usually will include one or more processors 18 and associated memory(ies) 16, a user interface (UI) 64, and an input output device (I/O) 66 for communicating with external devices. Memory 16 may include, for example, hard disk drives, random access memory, and read only memory.

FIG. 9 is a close-up view of one of the developers 52 from printer 44 shown in FIG. 8. Referring to FIG. 9, developer 52 includes a housing 68 with an ink inlet 70 and an ink outlet 72, each of which is associated with an ink reservoir 74. Ink from reservoir 74 is pumped into a local supply chamber 76 and reclaimed ink is collected in a local return chamber 78 and returns to reservoir 74 through outlet 72. A developer roller 80 presents a thin layer of ink 28 to photoconductor 46. Developer 52 also includes a squeegee roller 82 for removing excess ink from roller 80 in advance of photoconductor 46 and a cleaning unit 84 for cleaning residual ink from roller 88 after photoconductor 46.

In operation, supply chamber 76 is pressurized to force ink up through a channel 86 to the electrically charged developer roller 80, as indicated by flow arrows 88. A thin layer of ink is applied electrically to the surface of developer roller 80 along an electrode 90. In one example, developer roller 80 is charged to about −450 volts and electrode 90 is charged to about −1500 volts. The large difference in voltage between electrode 90 and developer roller 80 causes charged ink particles to adhere to roller 80 while the generally neutral carrier liquid is largely unaffected by the voltage difference.

Squeegee roller 82 is also charged to a higher voltage than developer roller 80, about −750 volts for example. The electrically charged squeegee roller 82 rotates against developer roller 80 to mechanically squeegee excess carrier liquid from the layer of ink 28 on roller 80. Charged ink particles continue to adhere to the lower voltage developer roller 80. The now more concentrated layer of ink 28 remaining on developer roller 88 is then presented to photoconductor 46 where some of the ink is transferred to the photoconductor to develop the latent electrostatic image on the photoconductor into an ink image. Excess carrier liquid and ink drains to return chamber 78 as indicated by flow arrows 92. One or more power supplies 12 apply the desired voltages to the components of each developer 52. The voltage applied and current drawn by each component may be monitored by voltage and current meters 24, 26 (shown in FIG. 1) or other suitable sensors both for maintaining the correct operating parameters and for determining the conductivity of ink 28 as described below with reference to FIGS. 10-13.

Figure 11:
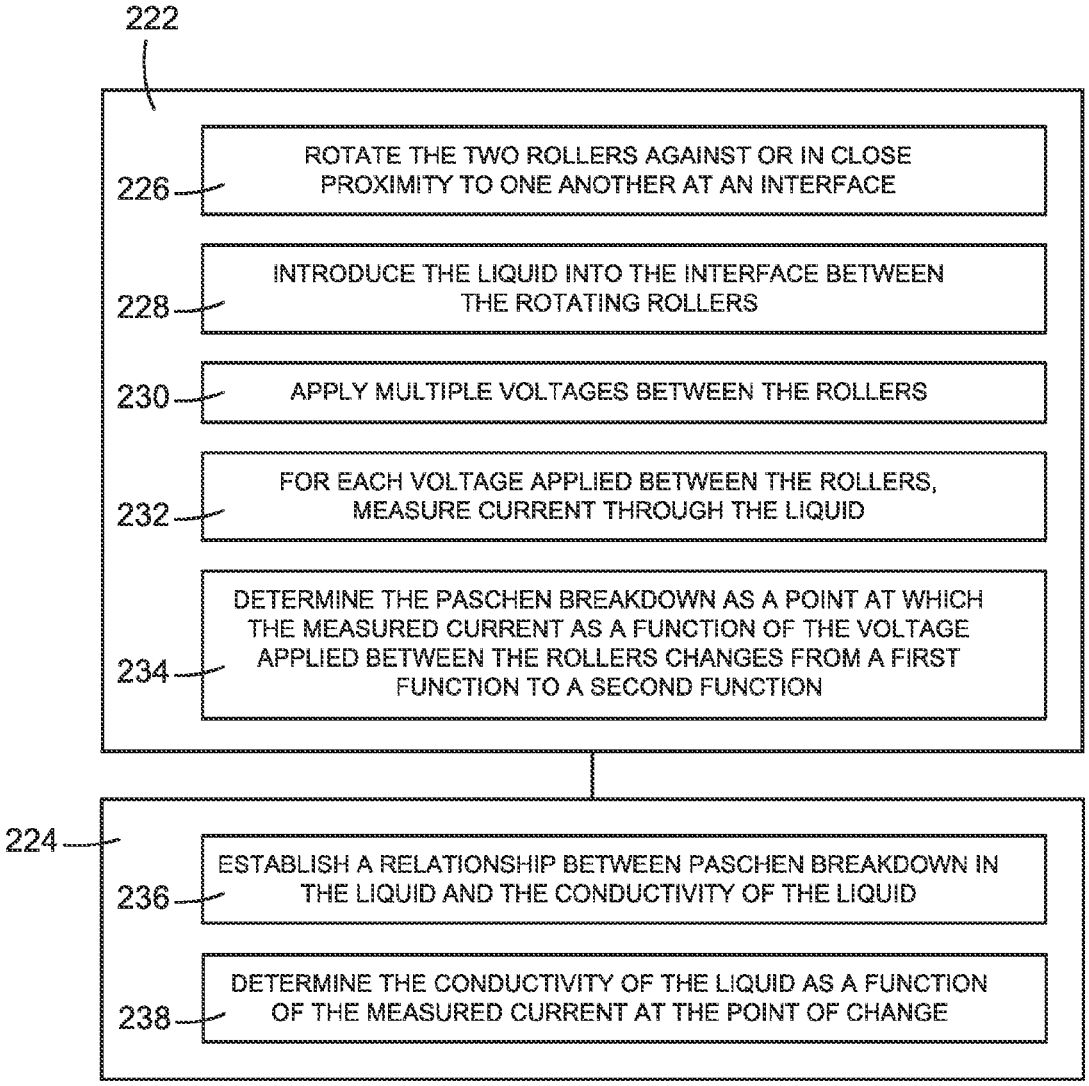
FIG. 11 is a flow diagram illustrating one specific implementation of the method of FIG. 10.
Figure 12:
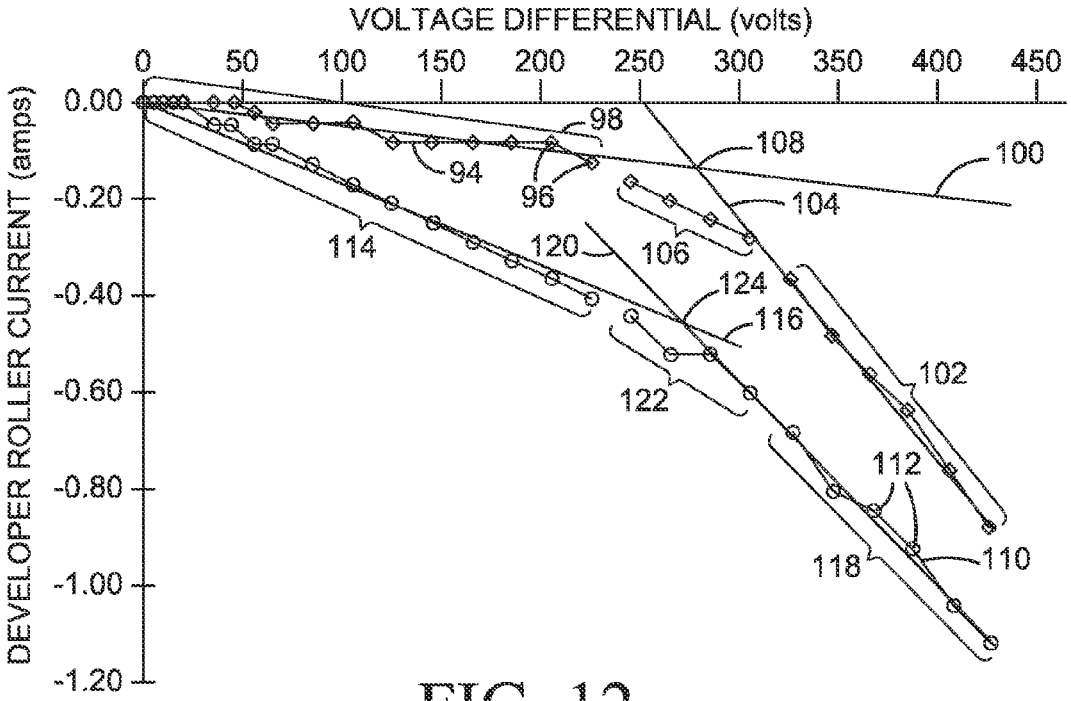
FIGS. 12 and 13 are graphs illustrating one example of a set of functions for determining the conductivity of an LEP ink using the method of FIG. 11.
Figure 13:
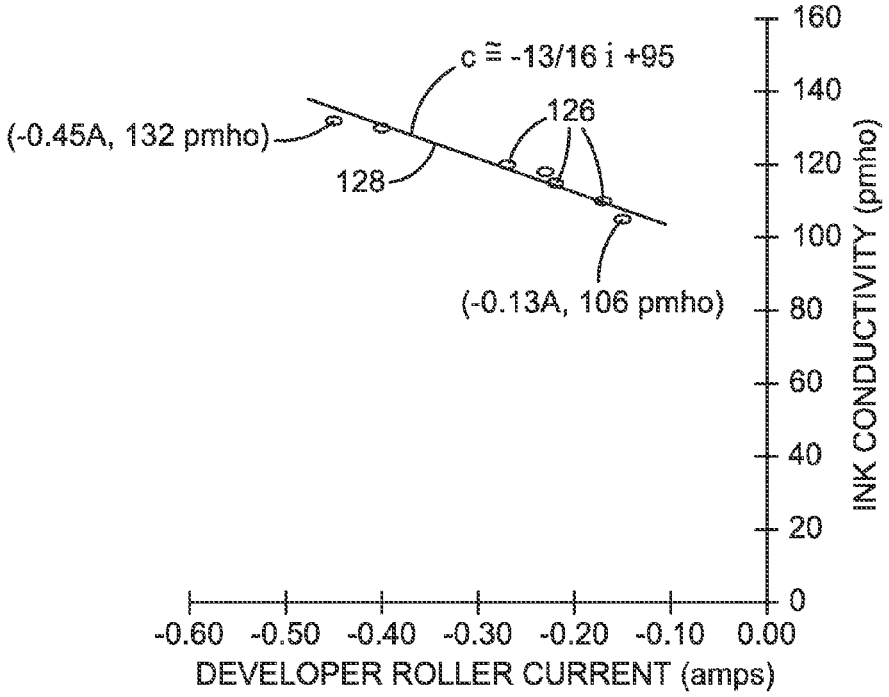

FIG. 10 is a flow diagram illustrating one example of a method 220 for determining the conductivity of a liquid at the interface between two rotating rollers. FIG. 11 is a flow diagram illustrating one specific implementation of method 220 in FIG. 10. Method 220 may be applied to LEP ink 28 in printer 44 at interface 30 between developer roller 80 and squeegee roller 82. FIGS. 12 and 13 are graphs illustrating one example set of functions for determining the conductivity of an LEP ink using the method of FIGS. 10 and 11.

Referring to FIGS. 7-10, programming 32 in printer controller memory 16 includes instructions that when executed by processor 18 cause system 10 to determine a Paschen breakdown of ink 28 between rollers 80 and 82 (block 222 in FIG. 10) and determine the conductivity of ink 28 based on the Paschen breakdown (block 224 in FIG. 10). In the specific implementation shown in FIG. 11, ink is introduced into interface 30 between rotating rollers 80 and 82 (blocks 226 and 228 in FIG. 11) and multiple voltages applied between the rollers (block 230 in FIG. 11). For each voltage, the current through ink 28 at interface 30 (referred to as the developer roller current) is measured (block 232 in FIG. 11) and Paschen breakdown is determined as the point at which the measured developer roller current as a function of the applied voltage changes from a first function to a second function (block 234 in FIG. 11). Once a relationship between Paschen breakdown in the ink and the conductivity of the ink has been established (block 236 in FIG. 11), the conductivity of ink 28 may be determined as a function of the measured current at the point of change (block 238 in FIG. 11).

FIGS. 12 and 13 represent one example of a relationship between LEP ink conductivity and Paschen breakdown established empirically under controlled conditions for an LEP printer 44. FIG. 12 shows the functional relationship between the measured current and the applied voltage for two LEP inks whose conductivity is known and the point at which this relationship changes from a first function to a second function. FIG. 13 shows the functional relationship between the measured current at the point of change in FIG. 12 and the conductivity of the LEP ink.

Referring to FIG. 12, a first curve 94 through test data points 96 shows the developer roller current as a function of the applied voltage for a first LEP ink having a conductivity of 106 pmho. Curve 94 includes a first region 98 characterized by a first best fit line 100 having a first slope, a second region 102 characterized by a second best fit line 104 having a second slope steeper than the first slope, and a third region 106 between the first and second regions 98, 102. The "knee" in first curve 94 through third region 106 is characteristic of the transition from a first type of conduction in the ink in first region 98 to a second type of conduction in the ink in second region 102. For convenience, the first type of conduction is referred to herein as "reverse bias" conduction because it is observed at lower voltage differentials and the second type of conduction is referred to herein as "Paschen breakdown" because it is observed at higher voltage differences. Reverse bias conduction tends to represent the conductivity of the ink exposed to lower electric fields, so-called "low field conductivity", and Paschen breakdown tends to represent the conductivity of the ink under higher electric fields, so-called "high field conductivity."

The point of intersection 108 of first line 100 and second line 104 is the point at which the developer roller current as a function of the applied voltage changes from a first function (first line 100 in this example) and a second function (second line 104 in this example) and may be used to identify the Paschen breakdown. Accordingly, as noted above, "Paschen breakdown" means the point at which (or the region through which) the relationship between current and voltage changes from one function to another function. Thus, the developer roller current at the Paschen breakdown for the first ink (conductivity=106 pmho) is about −0.13 A. A developer roller current of −0.13 A for the first ink with conductivity 106 pmho is one of the data points for the graph of FIG. 13.

Still referring to FIG. 12, a second curve 110 through test data points 112 shows the developer roller current as a function of the applied voltage for a second LEP ink having a conductivity of 132 pmho. Curve 110 includes a first region 114 characterized by a first best fit line 116 having a first slope, a second region 118 characterized by a second best fit line 120 having a second slope steeper than the first slope, and a third region 122 between the first and second regions 114, 118. The "knee" in second curve 110 through third region 122 is characteristic of the transition from reverse bias conduction through the ink in first region 114 to a Paschen breakdown in the ink in second region 118.

The point of intersection 124 of first line 116 and second line 120 is the point at which the developer roller current as a function of the applied voltage changes from a first function (first line 116 in this example) and a second function (second line 120 in this example) and may be used to identify the Paschen breakdown. Thus, the developer roller current at the Paschen breakdown for the second ink (conductivity=132 pmho) is about −0.48 A. A developer roller current of −0.45 A for the second ink with conductivity 132 pmho is another data points for the graph of FIG. 13.

The test procedure described above with reference to FIG. 12 is repeated until a desired number of data points are obtained to establish a relationship between developer roller current and ink conductivity. In the example shown in FIG. 13, seven data points 126 are used to establish a best fit line 128 defining the relationship between developer roller current and ink conductivity. Once this relationship is established, the conductivity of LEP ink 28 may be determined as described above, for example by plotting the developer roller current at Paschen breakdown to line 128, by looking up the conductivity in a table, or by computing the conductivity according to the equation defining line 128

$$\left(c \cong \frac{-13}{16} i + 95,\right.$$

where c is the conductivity of the ink and i is the developer roller current at Paschen breakdown).

The relatively large current associated with the Paschen breakdown of ink between rollers 80, 82 in developer 52 can vaporize of otherwise damage the ink, particularly if a static ink layer is subjected to larger currents over an extended period of time. Consequently, it will be desirable in most operating environments for ink 28 at interface 30 between rollers 80, 82, and more generally for a liquid 28 at interface 30 between surfaces 21, 23 in FIGS. 1 and 2, to move the liquid 28 at interface 30 to avoid damaging the liquid. For example, the supply of ink 28 to interface 30 between rollers 80, 82 is constantly replenished in developer 52 as the ink is transferred to photoconductor 46 for printing.

The examples shown in the figures and described above illustrate but do not limit the invention. Other examples may be made and implemented. Therefore, the foregoing description should not be construed to limit the scope of the invention, which is defined in the following claims.

What is claimed is:

1. A non-transitory processor-readable medium having instructions thereon that, when executed by a processor, cause a system to:

detect a change in electrical conduction of a liquid moving at an interface between two surfaces; and determine a conductivity of the liquid based on the detected change in conduction;

wherein the instructions for detecting a change in electrical conduction comprise instructions that, when executed by the processor, cause the system to:

apply multiple voltages between the surfaces;

for each voltage applied between the surfaces, measure current through the liquid; and detect the change in conduction as a point at which the measured current as a function of the applied voltage changes from a first function to a second function.

2. The medium of claim 1, wherein the instructions for determining a conductivity of the liquid comprise instructions that, when executed by the processor, cause the system to determine the conductivity of the liquid as a function of the measured current at the point of change.

3. The medium of claim 2, having further instructions thereon that, when executed by the processor, cause the system to move one or both surfaces relative to the other surface and introduce liquid into the interface between the surface while moving one or both surfaces, and wherein the instructions for applying voltages and measuring current comprise instructions for applying voltages and measuring current while moving one or both surfaces and introducing liquid into the interface between the surfaces.

4. The medium of claim 3, wherein the first function is a first line having a first slope and the second function is a second line having a second slope steeper than the first slope.

5. A system for determining the conductivity of a liquid, comprising:

a first curved surface;

a second curved surface; and a controller configured to:

move one or both surfaces close to or against the other surface;

apply multiple voltages between the surfaces while one or both surfaces are moving;

for each voltage applied between the surfaces, measure current through a liquid between the surfaces;

determine a point at which the measured current as a function of the applied voltage changes from a first function to a second function; and determine a conductivity of the liquid as a function of the point of change.

6. The system of claim 5, wherein:

the first curved surface is defined by a first roller and the second curved surface is defined by a second roller; and the controller is configured to move one or both surfaces by rotating one or both rollers close to or against the other roller.

7. The system of claim 5, further comprising a power supply to apply the voltages between the surfaces at the direction of the controller.

8. The system of claim 5, wherein the first function is a first line having a first slope and the second function is a second line having a second slope steeper than the first slope.

9. A printer, comprising:

a photoconductor;

an imaging device to form a pattern of a desired image on the photoconductor;

an image developer including a first roller to apply LEP ink to the photoconductor and a second roller;

a transfer member to transfer an ink image from the photoconductor to a print substrate; and a controller including a memory and a processor operatively connected to the memory to execute programming instructions on the memory, the memory having programming thereon with instructions for:

rotating the first and second rollers close to or against one another at an interface;

introducing LEP ink into the interface between the rotating rollers;

identifying a Paschen breakdown in the LEP ink at the interface; and determining a conductivity of the LEP ink based on the identified Paschen breakdown.

10. The printer of claim 9, wherein the instructions for determining the conductivity of the ink include instructions for:

applying multiple voltages between the rollers;

for each voltage applied between the rollers, measuring current through the ink at the interface; and determining the Paschen breakdown as a point at which the measured current as a function of the voltage applied between the rollers changes from a first function to a second function; and determining the conductivity of the liquid as a function of the point of change.

11. The printer of claim 10, wherein the instructions for determining the Paschen breakdown include instructions for interpreting the first function as a first line having a first slope and the second function as a second line having a second slope steeper than the first slope.

12. A method for determining the conductivity of a liquid, comprising:

moving a liquid between two surfaces;

identifying a Paschen breakdown for the liquid between the two surfaces;

determining a conductivity of the liquid based on the identified Paschen breakdown;

wherein moving the liquid between two surfaces comprises:

moving one or both of two rollers against or in close proximity to one another at an interface; and introducing liquid into the interface between the rollers;

and determining the conductivity of the liquid comprises:

applying multiple voltages between the rollers;

for each voltage applied between the rollers, measuring current through the liquid at the interface; and determining the Paschen breakdown as a point at which the measured current as a function of the voltage applied between the rollers changes from a first function to a second function.

13. The method of claim 12, wherein the first function is a first line having a first slope and a second function is a second line having a second slope steeper than the first slope.

* * * * *